US005803658A

United States Patent [19]

Allen

[11] Patent Number: 5,803,658

[45] Date of Patent: Sep. 8, 1998

[54] RIDING TROWEL WITH COUNTER ROTATING ROTORS

[75] Inventor: J. Dewayne Allen, Paragould, Ark.

[73] Assignee: Allen Engineering Corp., Paragould, Ark.

[21] Appl. No.: 783,332

[22] Filed: Jan. 15, 1997

[51] Int. Cl.[6] ..... E01C 19/22

[52] U.S. Cl. ..... 404/112

[58] Field of Search ..... 404/112

[56] References Cited

U.S. PATENT DOCUMENTS

| | | | |
|---|---|---|---|
| 3,936,121 | 2/1976 | Holz, Sr. et al. | 404/112 |
| 4,046,484 | 9/1977 | Holz, Sr. et al. | 404/112 |
| 4,775,306 | 10/1988 | Kikuchi et al. | 425/62 |
| 5,108,220 | 4/1992 | Allen et al. | 404/112 |
| 5,238,323 | 8/1993 | Allen et al. | 404/85 |
| 5,480,257 | 1/1996 | Allen | 404/112 |
| 5,480,258 | 1/1996 | Allen | 404/112 |
| 5,584,898 | 12/1996 | Watanabe et al. | 404/112 |
| 5,685,667 | 11/1997 | Allen | 404/112 |

*Primary Examiner*—Tamara L. Graysay
*Assistant Examiner*—Gary S. Hartman
*Attorney, Agent, or Firm*—Stephen D. Carver

[57] ABSTRACT

In a powered riding trowel of the type having at least two adjacent rotor assemblies wherein said rotor assemblies include rotors which are counter rotating relative to one another, and wherein the rotors circumscribe a circular path during operation, the rotor assemblies being affixed to a framework such that the paths circumscribed by the rotors are spaced apart so that tangential forces developed along the circumference of the respective paths do not interact to reinforce one another.

2 Claims, 4 Drawing Sheets

RIDING TROWEL WITH COUNTER ROTATING ROTORS

The present invention relates, in a broad sense, to motorized riding, or ride on, trowels having at least two rotor assemblies in which the rotors are counter rotating and, more particularly, to improvements in such riding trowels, particularly when pans are used to enhance the finish of the surface of the concrete to be worked.

BACKGROUND OF THE INVENTION

1. Field of the Invention

The riding trowel, perhaps has its genesis in early developments in the 1970's. Prior to that time, green concrete surfaces were leveled and finished by hand, or with a single powered rotor, which achieved locomotion by being manipulated by the operator, thus the colloquial designation, walk behind trowel.

It is a universal truth, not only in the construction industry, but in the business world, that time is money. Thus, as the size of concrete pads has grown, so too has the time it takes to finish the surface. The ride on trowel was a pioneering effort to increase efficiency and cut down on labor costs in the cement finishing field.

Since the advent of the first motorized ride on trowels, there have been several advances, many of which have been fathered by the present inventor. An advance in the art, however, often brought with it a new set of problems, and when the present inventor developed the ride on trowel having counter rotating rotors, a distraction was found to be inherent, which, although not a significant detriment, was an impediment to the optimal efficiency that this development would otherwise provide.

The next step forward, again by the present inventor, was in the use of pans on riding trowels to further enhance the finish that these motorized devices could achieve. The pans are literally cylindrical bodies with a flat bottom portion. The pans fit snugly over the rotor blades and are driven by the rotating blades in a rotary motion. The flat bottom surface applies an exceptionally smooth finish to the surface of the green concrete being worked, as distinguished from the rotating blades of a rotor assembly, which tend to leave a spiral pattern of concentric circles defined by minute, or at least hopefully minute, ridges in the surface.

Even with the use of pans and, in some instances, especially the use of pans, resulted in the undesirable formation of a ridge and some rippling of the green concrete along a path that essentially bisected the plane defined by the drive shafts of adjacent rotors. The time honored way of correcting such deformities in the surface of the concrete, is to go over the effected area again, perhaps with a walk behind, or by making a pass with a ride on in a different direction. That solution, however, requires additional time and fuel and is, therefor, not a truly satisfactory resolution of the problem.

It is within this environment that the present invention was created.

2. Overview of the Prior Art

As previously mentioned, the Holz U.S. Pat Nos. 3,936,212 and 4,046,484 appear to have been the progenitor of the ride on trowel. While the world knew that one could steer a walk behind trowel by tipping the rotor assembly one way or another, it was Holz that first synthesized that knowledge, and applied it to a power trowel having at least two rotor assemblies in order that the operator, sitting atop the device, could steer it from that location.

It was, Allen, however, who advanced the quantum of knowledge in the field by improving the steerability of ride on trowels, as memorialized in his U.S. Pat. No. 5,108,220. The art was further advanced with the advent of the contra-rotating rotors, as described in the Allen U.S. Pat. application Ser. No. 08/587,014. Again, in Allen U.S. Pat. No. 5,480,257, the use of pans, and a means of accommodating pans on a rotor machine is presented for those skilled in the art. That disclosure includes means for adjusting the position of the rotor assemblies a small amount relative to the frame to accommodate the pans, the use of which obviates the use of any overlap between and among the blades of the adjacent rotors.

While the forgoing constituted significant improvements, particularly in the steerability and performance of ride on trowels, with those improvements came new challenges in the form of certain problems, as articulated above, which Allen has set out to ameliorate, and has now done so, successfully.

SUMMARY OF THE INVENTION

With the foregoing by way of background, it will be seen that a primary objective of the present invention is to provide a motorized riding trowel having a minimum of two rotor assemblies in which the rotors rippling of the surface of the concrete to be worked is, if not entirely eliminated, substantially minimized.

It is an adjunct to the foregoing objective to accomplish that objective without decreasing the efficiency of the subject machine, or materially adding to the labor and other costs incident to the finishing process.

A further objective of the present invention is to enhance the efficiency of a multi-rotor riding trowel of the type wherein the rotors counter rotate, by eliminating problems inherent in the area of a bisection of the plane defined by the axes of rotation of adjacent rotors.

Finally, but certainly not exhaustively, it is an objective of the present invention to accomplish all of the foregoing objectives with no diminution of the otherwise excellent steering and handling characteristics of the trowel over which the present invention represents an improvement.

The foregoing, as well as other objects and advantages of the present invention, will become clear upon reading the following detailed description, taken in conjunction with the accompanying drawings, wherein:

IN THE DRAWINGS

DETAILED DESCRIPTION OF A PREFERRED EMBODIMENT

Figure 1:
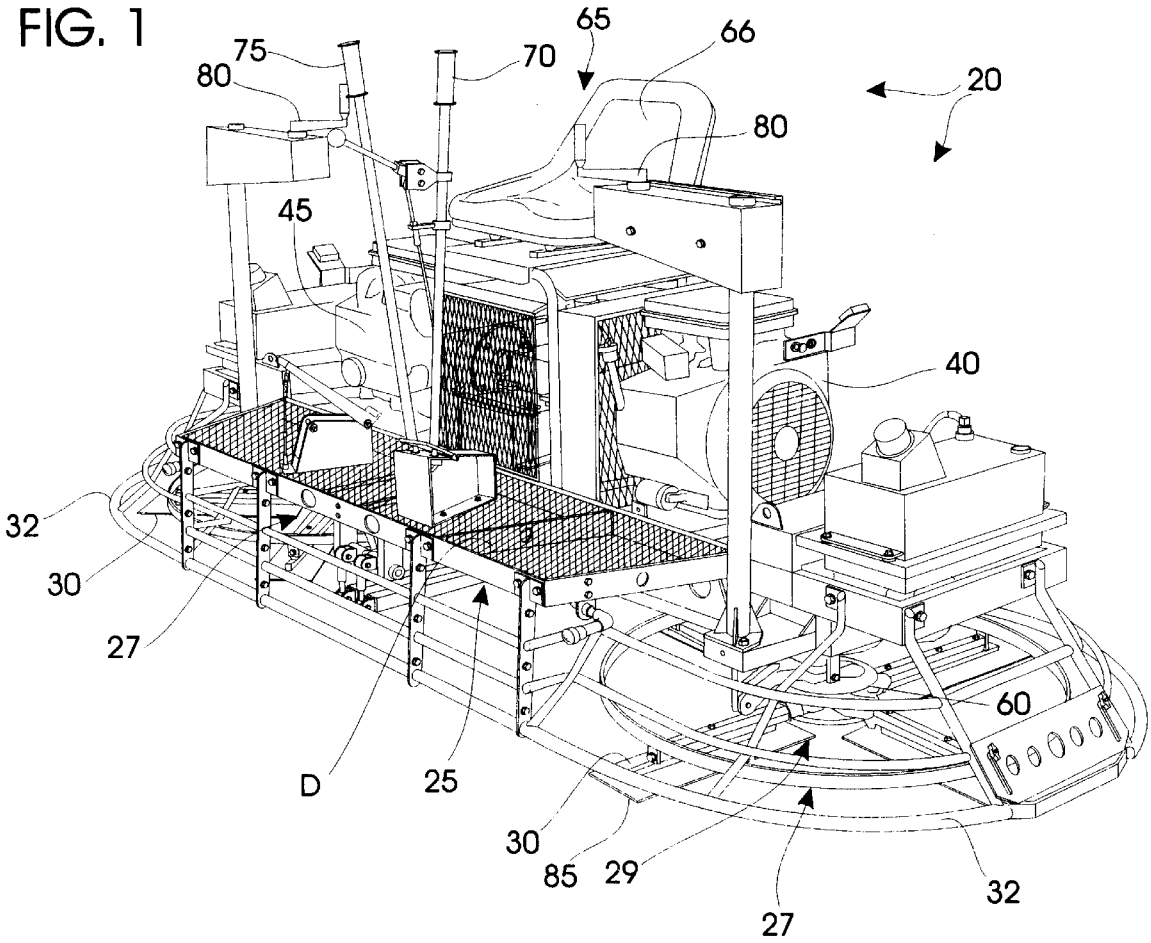
FIG. 1 is a perspective of a ride on trowel of the type having at least two adjacent rotor assemblies in which the rotors are counter rotating and, illustrating the improvement, which is the subject matter of the present invention.

With reference now to the accompanying drawings, and initially to FIG. 1, a riding trowel improved in accordance with the present invention is broadly designated by the reference numeral 20. The trowel 20, is generally of a now familiar configuration, and includes a frame 25 equipped with a pair of substantially identical twin rotor assemblies 27, which for purposes of this description, comprise generally a motor, motor driven gear box and an attached rotor 29, comprising, inter alia, a series of radially outwardly projecting blades 30.

Figure 3:
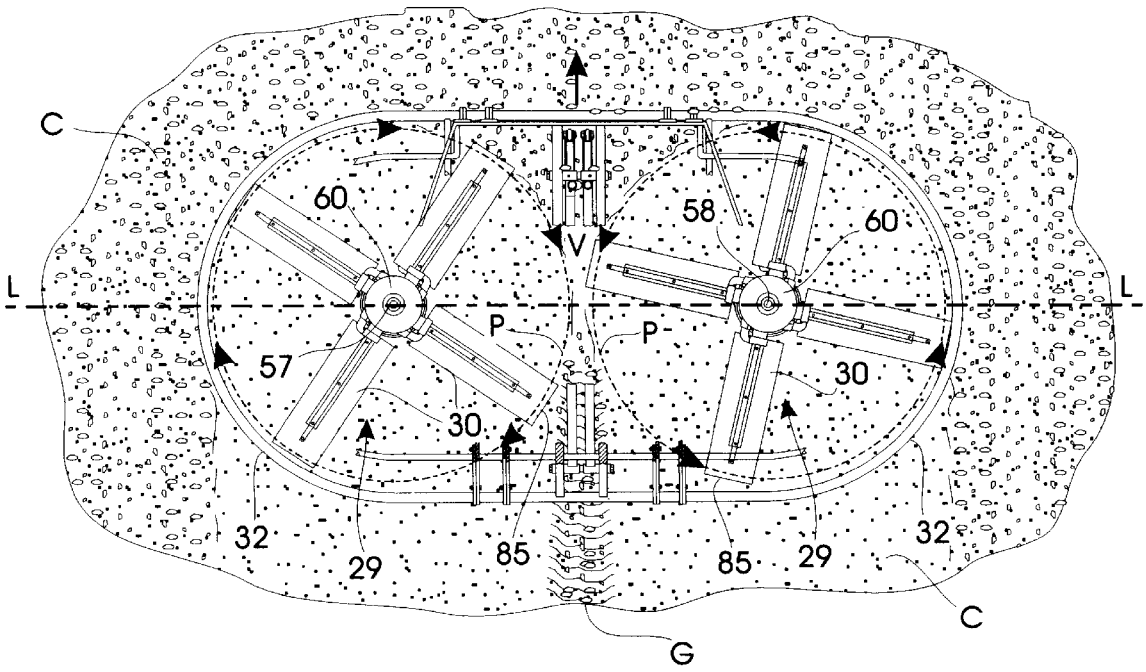
FIG. 3 PRIOR ART
FIG. 3 is a pictorial representation of the rotors of the trowel over which the present invention constitutes a distinct improvement.
Figure 4:
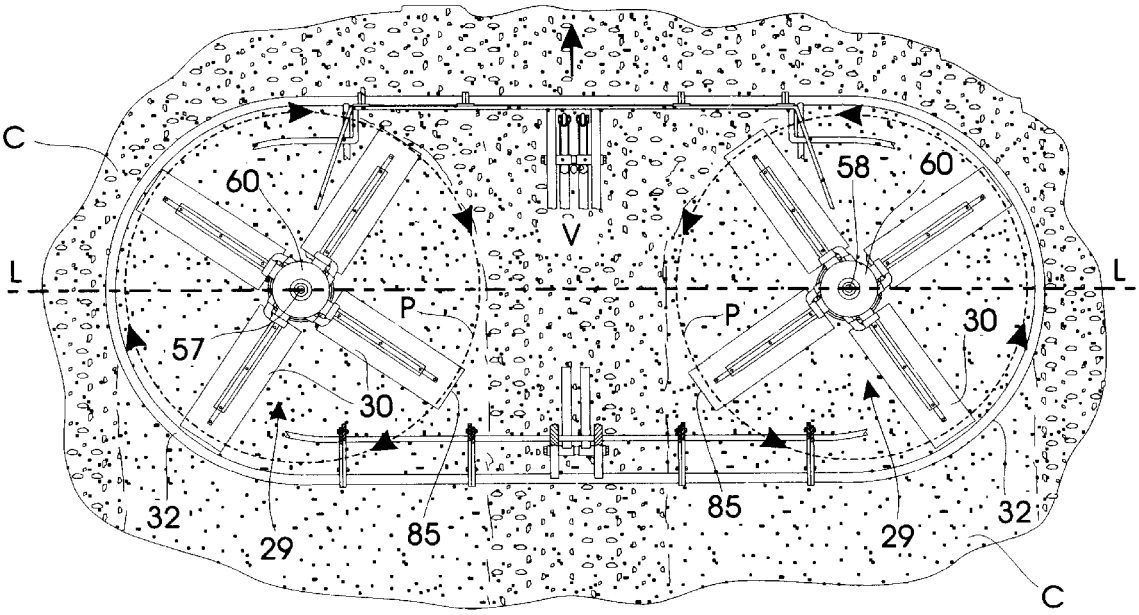
FIG. 4 is a view similar to FIG. 3 illustrating the improved trowel of the present invention; and, FIG. 4A is a view similar to FIG. 3A, demonstrating the results of the travel of the FIG. 4 trowel over the same patch of green concrete.

The rotors 29 are driven by the motor through the gear box, and they are counter rotating, such that as viewed from the operator's perspective, and shown in FIGS. 3 and 4, the left rotor is driven in a clockwise direction, and the rotor on the left rotates in a counterclockwise direction. When the rotors 29 and, thus, the blades 24 on each are rotated, they circumscribe a circular path P.

The trowel 20 is constructed about a durable metal frame 25. Depending from the frame 25 is a guard cage 32, that surrounds the rotor assemblies 27 as a safety measure, in order to inhibit unintentional contact by foreign objects, animate and inanimate, with the rotor assemblies during operation. During use, the rotor assemblies support the trowel 20 on the concrete surface C to be finished by operation of the trowel.

As referenced above, the trowel depicted is a two rotor trowel. It will be appreciated, however, that the improvements that are disclosed herein are equally applicable to any multiple rotor configuration so long as there are two adjacent rotors that are turning in opposite directions.

Figure 2:
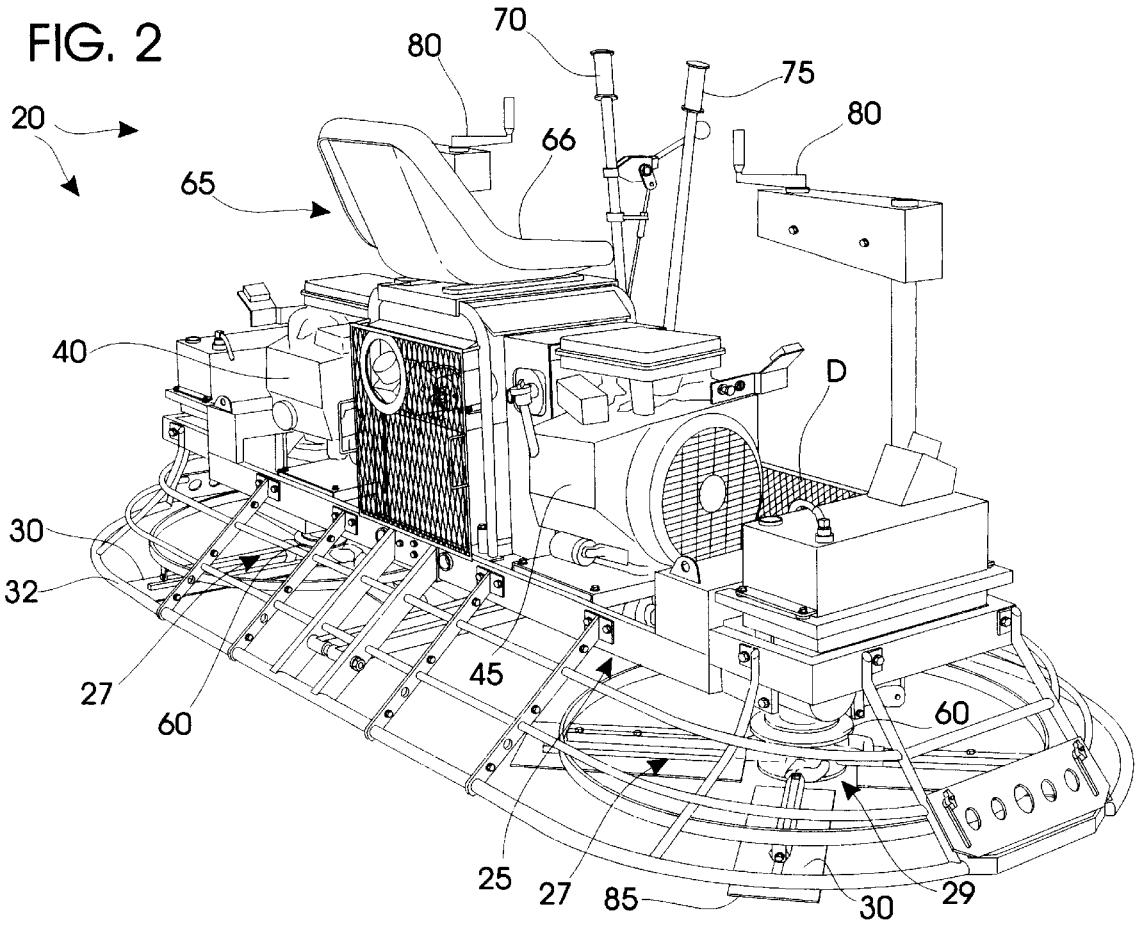
FIG. 2 is a perspective view of the trowel of FIG. 1, taken primarily, however, from the rear thereof.

Returning to FIGS. 1 and 2, the frame 25 mounts and secures for operation as part of the rotor assemblies 27, a pair of motors or engines 40, 45 that drive the rotor assemblies 27, respectively, in opposite directions, as more particularly described above.

Depending from each motor driven gear box, which is not clearly shown, but now well known in the art, are stub shafts 57 and 58, respectively. Each stub shaft is connected, in any suitable and well known fashion, to a central hub 60, forming the axis of each one of the rotors 29, thus completing the power circuit from motor to rotor. The blades 30 extend radially outwardly from the hub 60, as seen in FIGS. 3 and 4.

The blades 30, as is now recognized in the art, frictionally interact with the concrete surface C to be finished and coincidently support the trowel 20 and its operator during operation of the trowel.

As stated from the beginning, the present invention relates to riding, or ride on, trowels, and, to that end, an operator station 65, which includes a seat 66 is mounted to the top of the frame 25, extending above the deck D which reposes on the frame 25, adding not only strength, but a safe place for the operator to perform his or her function.

The trowel, in order to provide a steering function, as well as finish control, is fitted with a plurality of relatively sophisticated operating controls conveniently disposed within easy reach of a seated operator. The controls, and their function in the scheme of things, are the subject of one or more patents issued to the present inventor.

In the depicted configuration, the operator steers the trowel 20 by means of two primary control levers 70, 75 (FIG. 1), respectively. The levers 70, 75 are so constructed as to manipulate gearboxes, which comprise a part of the rotor assemblies 27, and which functionally interconnect each motor 40, 45 and an associated rotor 29 through stub shafts in the manner previously described.

As is taught in Allen U.S. Pat. No. 5,108,220, the attitude of each gear box is independently determined at any given moment by the operator, and the attitude of the gearboxes determines the angle or degree of tilt of each of the rotor assemblies 27 to thereby generate steering forces. Movement of the trowel along a selected path is the result of reactive frictional forces generated on the surface of the concrete by the position and direction of rotation of the rotors 29, as the blades rotate, scraping against the concrete surface C.

The operator also has at his disposal, means for determining the pitch of each group of blades 30 defining, with the hub 60, a rotor 29, and any suitable means, including manual, fluid driven, and electrical may be employed without departure from the invention, although manual controls 80 are illustrated. Adjustment of the angle of the blades relative to the surface C permits the operator to control the quality of the finish being applied to that surface.

Figure 3A:
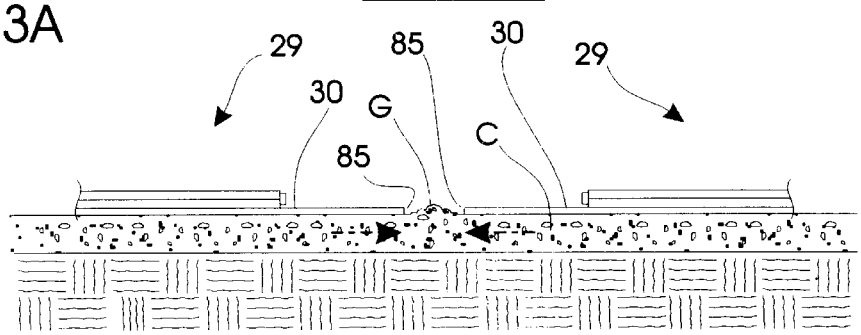
FIG. 3A PRIOR ART
FIG. 3A is a view of a patch of green concrete, illustrating the potential damage that may occur when the trowel of FIG. 3 is postured for a forward or rearward movement.

As briefly referenced above, and as may be envisioned by particular reference to FIGS. 3 and 3A, a vertical plane is defined by the stub shafts 57, 58 and at a point P which bisects a line L—L stretched between the stub shafts within that plane, the forces generated by the counter rotating blades reinforce one another, and are thus multiplied, since along that line, and at the point of bisection, the blades of each of the rotors are moving, at the point P, in the same direction, and the tangential forces, graphically depicted by vectors V, generated at the tips of the blades as they arrive at point P are united, and consequently magnified by at least a factor of two, in the direction of travel, either a forward or aft direction, dependent on the direction of rotation of the rotors 29. There is, of course, an equal and opposite reactive force generated on the green concrete surface.

The magnitude of the effect of these forces on the concrete surface to be finished depends on several factors, not the least of which is the gross weight of the trowel 20, and operator, and the state of the cure and mix of the concrete.

By way of example, if the trowel is relatively lighter, and the concrete well along in the curing process, the reactive forces on the concrete will cause the trowel to be propelled in a direction opposite to the vectors V. As the trowel becomes relatively heavier, and where the concrete relatively green, the result is a gouging and rippling of the surface C, as seen in FIG. 3A at G, which is highly detrimental to the finishing process.

The problem is exacerbated when the operator is attempting to guide the trowel in the forward direction, which as seen in the FIG. 3 configuration, would be accomplished by tilting the rotors 29 toward one another. More precisely, in order to effect forward progress, the rotor assemblies are tilted downwardly in the area of point P, applying more forces in that area. Under such circumstances, it will be apparent to those skilled in the art, that gouging and rippling as at G is not only more likely, the severity interruption of the continuity of the concrete surface C that can be anticipated is significantly increased.

Figure 4A:
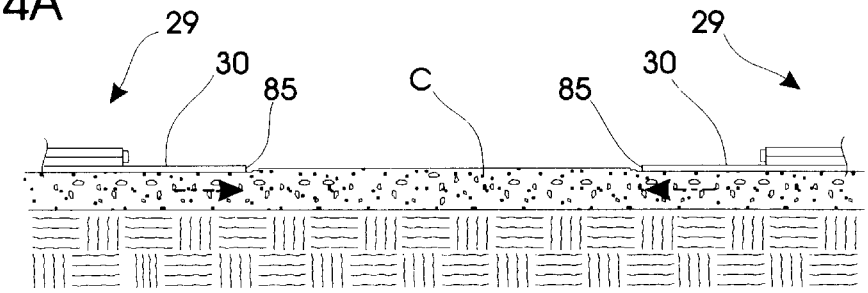

Having thus isolated and defined the problem, a solution offered by the present invention, is graphically represented in FIGS. 4 and 4A, and now described. Specifically, the circular paths circumscribed by the rotor blades 30 must be positioned such that the tangential forces V generated at the tips 85 of each rotor blade are not concentrated and, thus, unable to reinforce one another to cause a multiplication, thereby constraining the total forces acting on the green concrete at a point P, particularly during forward steering movements, to no more than the actual tangential forces generated at the tip of each blade as it moves along the circumferential path. Thus, the forces experienced at the concrete surface, do not adversely disturb the surface being finished.

Coincidently, it is imperative that the steering and handling characteristics of the trowel, which are considered excellent in the art, be undisturbed.

In order to accomplish these objectives, the distance separating the stub shafts 60, and coincidently, the hubs of each rotor in the vertical plane defined by those shafts is, in keeping with the invention, increased. While it is known in the art that the distance between rotors may be manipulated slightly by adjusting the position of the rotor assemblies to eliminate overlap in the circular paths of the rotors to thereby permit the use of pans, such a nominal movement would be, and is, unsatisfactory as a means of vitiating the problems herein recognized.

Thus, the present invention contemplates a spacing of adjacent rotor assemblies which will prevent reinforcing of the tangential forces generated at the tips of the blades.

To this end, adjacent rotor assemblies are positioned on the frame 25 in order that the distance between the rotor hubs 60 is in a preferred range between twice the diameter of the path circumscribed by the rotor blades and 1¼ times such diameter. In order to effect the desired spacing, it may be necessary to stretch, or elongate, the frame to accommodate the increase in the distance between adjacent rotors, which increase may be up to an amount equal to the diameter of the rotors.

By way of example, in a riding trowel in which the rotors are 46 inches in diameter, the distance between adjacent hubs 60 would range between 23 and 46 inches, and the frame 25, where necessary, would reflect that spacing.

While there may be some latitude in the ideal range of spacing, the result to be achieved, however, is the consistent elimination of ridging and rippling of the surface of the concrete being finished.

While the separation of the rotors disclosed herein creates a path between the rotors that is unfinished by the trowel, it is common practice to make more than one pass over the surface during the finishing process. The unfinished swath, therefore, is readily finished in a subsequent path. It would be extremely difficult in several subsequent passes, however, to cure the damage that is caused by the tangential forces V multiplying to create the ridging and rippling described above.

Having thus described the invention, in considerable detail, what is claimed is:

1. A self-propelled, motorized riding trowel comprising:

a frame supporting a pair of spaced apart rotor assemblies, each rotor having an axis of rotation separated by a predetermined length;

each of said rotor assemblies comprising a rotor, a plurality of radially spaced apart blades attached to and extending radially outwardly from said rotor, said blades having tips circumscribing a circular path of a predetermined diameter, and each said blade having tangential forces developed at said tips along the circumference of said circular path during rotor operation;

motor means for powering said rotor assemblies;

each of said adjacent rotor assemblies being driven so as to rotate in opposite directions relative to one another;

said adjacent rotor assemblies being supported by said frame in such relative position, said circular paths circumscribed by rotation of said blades of each said rotor are spaced apart by a distance sufficient to preclude said tangential forces developed at said tips as said tips move along said circular path from being reinforced by the tangential forces developed at said tips of an adjacent rotor;

wherein said predetermined length between the axis of rotation of each rotor assembly is approximately 1.5 times said diameter.

2. A self-propelled, motorized riding trowel comprising:

a frame supporting a pair of spaced apart rotor assemblies, each rotor having an axis of rotation separated by a predetermined length;

each of said rotor assemblies comprising a rotor, a plurality of radially spaced apart blades attached to and extending radially outwardly from said rotor, said blades having tips circumscribing a circular path of a predetermined diameter, and each said blade having tangential forces developed at said tips along the circumference of said circular path during rotor operation;

a separate motor means for powering each rotor assembly;

each of said adjacent rotor assemblies being driven so as to rotate in opposite directions relative to one another;

said adjacent rotor assemblies being supported by said frame in such relative position, said circular paths circumscribed by rotation of said blades of each said rotor are spaced apart by a distance sufficient to preclude said tangential forces developed at said tips as said tips move along said circular path from being reinforced by the tangential forces developed at said tips of an adjacent rotor;

wherein said predetermined length between the axis of rotation of each rotor assembly is approximately 1.5 times said diameter.

* * * * *